US005240373A

United States Patent [19]

Mita et al.

[11] Patent Number: 5,240,373

[45] Date of Patent: Aug. 31, 1993

[54] FAN WITH A RESISTANT PLATE

[75] Inventors: Yoshiyuki Mita, Shizuoka; Yuichi Ono, Numazu, both of Japan

[73] Assignee: Usui Kokusai Sangyo Kaisha Ltd., Shizuoka, Japan

[21] Appl. No.: 695,083

[22] Filed: May 3, 1991

[30] Foreign Application Priority Data

May 9, 1990 [JP] Japan ..... 2-117723

[51] Int. Cl.[5] ..... F04D 3/00; F04D 29/00

[52] U.S. Cl. ..... 415/211.2; 123/41.49

[58] Field of Search ..... 416/169 A; 415/182.1, 415/211.2; 123/41.49

[56] References Cited

U.S. PATENT DOCUMENTS

| | | | |
|---|---|---|---|
| 884,894 | 4/1908 | Carroll | 415/211.2 |
| 2,159,189 | 5/1939 | Wais | 415/211.2 |
| 4,173,995 | 11/1979 | Beck | 416/169 A |
| 4,184,541 | 1/1980 | Beck et al. | 123/41.49 |
| 4,590,889 | 5/1986 | Hiereth | 416/169 A |
| 4,634,342 | 1/1987 | Rodewald | 415/211.2 |

FOREIGN PATENT DOCUMENTS

| | | |
|---|---|---|
| 57-75199 | 5/1982 | Japan . |
| 59-176499 | 10/1984 | Japan . |

OTHER PUBLICATIONS

*Introduction to Fluid Mechanics,* Fox & McDonald, 1985, pp. 114–116.

*Primary Examiner*—Edward K. Look
*Assistant Examiner*—Michael S. Lee
*Attorney, Agent, or Firm*—Wenderoth, Lind & Ponack

[57] ABSTRACT

An axial-flow fan to be attached to an output shaft of an internal combustion engine is provided with a circular resistance plate disposed between the fan and the engine housing. The resistance plate extends perpendicularly to a fan driving output shaft of the engine, while surrounding the output shaft. Air flow flowing against the resistance plate is deflected in the radial directions, deviating from the output shaft. This air flow turns back toward the upstream side of the fan, turbulent flow is effectively minimized, and the absorption power of the fan is remarkably reduced.

2 Claims, 3 Drawing Sheets

FAN WITH A RESISTANT PLATE

BACKGROUND OF THE INVENTION

This invention relates to an improved arrangement of an axial-flow cooling fan attached to an internal combustion engine.

In recent automotive engines, miscellaneous equipments and optional accessories are attached to an output shaft on the side of a fan. For example, within a space between a radiator and a fan, many accessories such as a condenser of airconditioner, inter-cooler and oil cooler are disposed. Further, within a space between a fan and an engine housing, an alternator (generator), compressor of air conditioner, super charger and and other accessories are closely disposed. This results in an increase of air flow resistance around a cooling fan.

Fan blades of a fan receive upstream air and discharge it toward an engine housing in a pressurized condition. Since the pressure varies depending upon a distance from a central axis of the fan, some areas in upstream side of the fan holds a relatively low pressure than in the downstream side. Due to this imbalance of pressure, some of the air flow having passed through the fan blades turn back toward the central axis of the fan. This counter current flow gives rise to a loss of engine power.

In Japanese Patent Public Disclosure No. 176499/1984 (SHO 59-176499), there is disclosed a cooling apparatus wherein a fan boss having a taper section is utilized for preventing air flow from peeling off. Although this arrangement intends to improve an efficiency of the axial-flow fan, the width of the fan boss is so small that the effect is not so distinguished as expected.

In Japanese Utility Model Public Disclosure No. 75199/1982 (SHO 57-75199), there is disclosed a cooling fan wherein a frust-conical ring is disposed at a downstream side of the fan. Although this frust-conical ring can extend a diameter of air flow, the diameter of the ring is so small that the effect is not so distinguished as expected.

SUMMARY OF THE INVENTION

It is an object of the present invention to provide an improved fan which can eliminate a counter flow and peeling off flow causing a power loss of an engine.

Another object of the invention is to provide an improved fan which is applicable to existing engines with minor modifications.

According to the present invention, there is provided a new and improved fan in which a circular resistant plate is disposed between a fan and an engine housing. This resistant plate extends perpendicularly to a fan driving output shaft, while surrounding the output shaft. Thus, air flow running against the resistant plate is deflected toward radial directions, deviating from the output shaft.

Different from the conventional deflecting means, this resistant plate extends perpendicularly to the engine output shaft. Therefore, no air flow turns back to the upstream side. Most of conventional turbulent flow are effectively eliminated.

Surprisingly, according to the invention, absorption power by the fan is considerably reduced, whereby the fan efficiency remarkably grows up.

According to a result of experiments, it is preferable to determine the outside diameter of the resistant plate in a range from 80 to 90 percent of the outside diameter of the fan.

In a preferable embodiment, the resistant plate comprises a small disk portion attached to a fan boss, a tubular portion extending parallel to the output shaft, and a large disk portion extending radially to the output shaft.

In another embodiment, a frust-conical tube portion can substitute for the tubular portion.

In still another embodiment, the resistant plate can be mounted on an engine housing in a stable fashion.

Embodiments of the invention will now be described by way of example with reference to the drawings, in which like reference numerals refer to like elements in the several views.

DESCRIPTION OF THE PREFERRED EMBODIMENT

Figure 1:
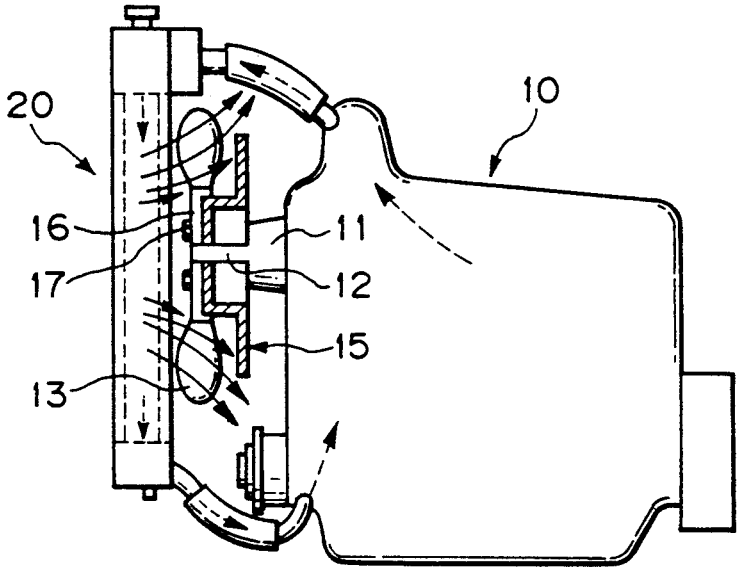
FIG. 1 is a shematic elevational view, partly in section, of an arrangement including an engine, radiator and fan according to the present invention.
Figure 2:
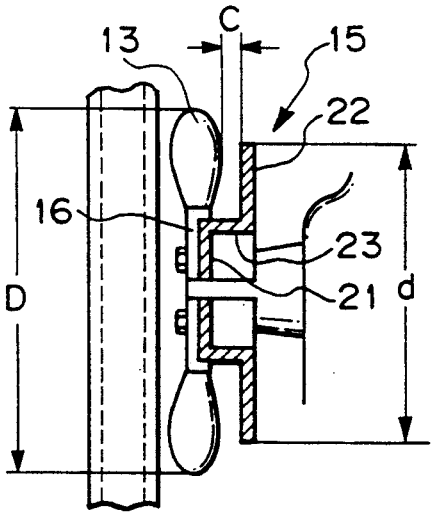
FIG. 2 is a partially extended view of FIG. 1.

Referring to FIGS. 1 and 2, there is shown a preferable arrangement according to a first embodiment of the invention. An axial-flow fan 13 is mounted on a fan driving output shaft 12 which extends from a fan hub 11 of an engine 10. In front of the fan 13, is disposed a radiator 20 in which cooling water flows along the directions shown by arrows.

Depending upon the present invention, within a space between the fan 13 and the engine 10, is disposed a circular resistant plate 15 which extends perpendiculary to the output shaft 12, while surrounding the shaft 12. The plate 15 is mounted on a fan boss 16 by means of bolts 17.

As shown in FIG. 2, the resistant plate 15 comprises a small disk 21 adapted to abut with the fan boss 16, a large disk 22 located near the fan blades of the fan 13, and a tubular portion 23 interconnecting the small disk 21 and the large disk 22.

Depending upon the above arrangement, as shown by the arrows in FIG. 1, air flow running against the resistant plate 15 is deflected toward radial directions, nearly perpendiculary to the output shaft 12. Thus, no air turns back to the upstream side. Peeling off and turbulent flow of air are minimized.

Many experiments were done for obtaining the relations among the values of an outside diameter D of the fan 13, an outside diameter d of the resistant plate 15, and a clearance C between the fan 13 and the large disk 22. As the results, it has been found that a best efficiency is obtained under the condition that the diameter d of the plate 15 is set in a value from 80 to 90 percent of the diameter D of the fan 13, and the clearance C is set in a value about one twentieth (5 percent) of the diameter D.

Figure 3:
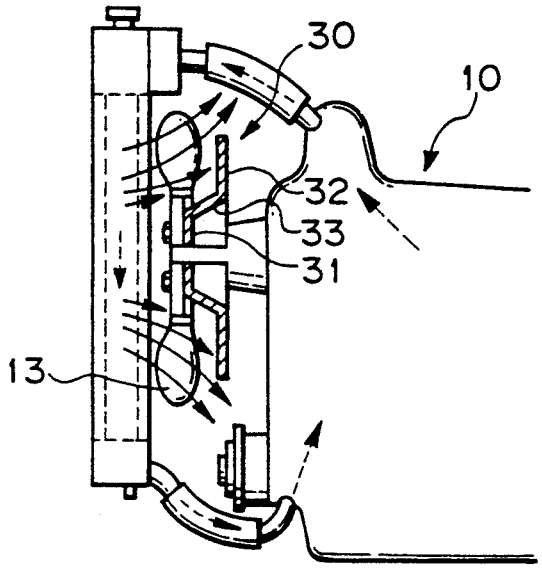
FIG. 3 is a shematic elevational view, partly in section, of a second embodiment of the invention.

FIG. 3 shows a second embodiment of the invention. In this figure, the resistant plate 30 comprises a small disk 31, a large disk 32, and a frust-conical tubular portion 33 which interconnects the small disk 31 and the large disk 32. The frust-conical portion 33 can provide a further smoothing air flow around the resistant plate 30.

Since the resistant plates 15 and 30 are both mounted on the respective fan boss, they rotate together with the fan 13.

Figure 4:
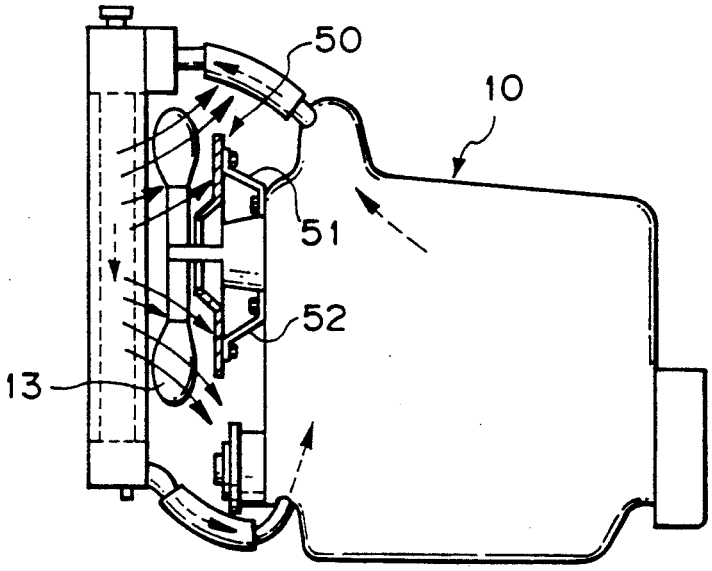
FIG. 4 is a shematic elevational view, partly in section, of a third embodiment of the invention.

FIG. 4 shows a third embodiment of the invention. In this figure, the resistant plate 50 is mounted on a housing of the engine 10 by means of mounting brackets 51 and 52. Therefore, the plate 50 remains stable during the rotation of the fan 13. This plate 50 has an advantage that it does not influence upon the rotational characteristic of the fan 13.

The resistant plates 15, 30, 50 shown in FIGS. 1 to 4 are easily applicable to existing engines by adding a small modification to the fan arrangements. This is an excellent feature of the present invention.

Figure 5:
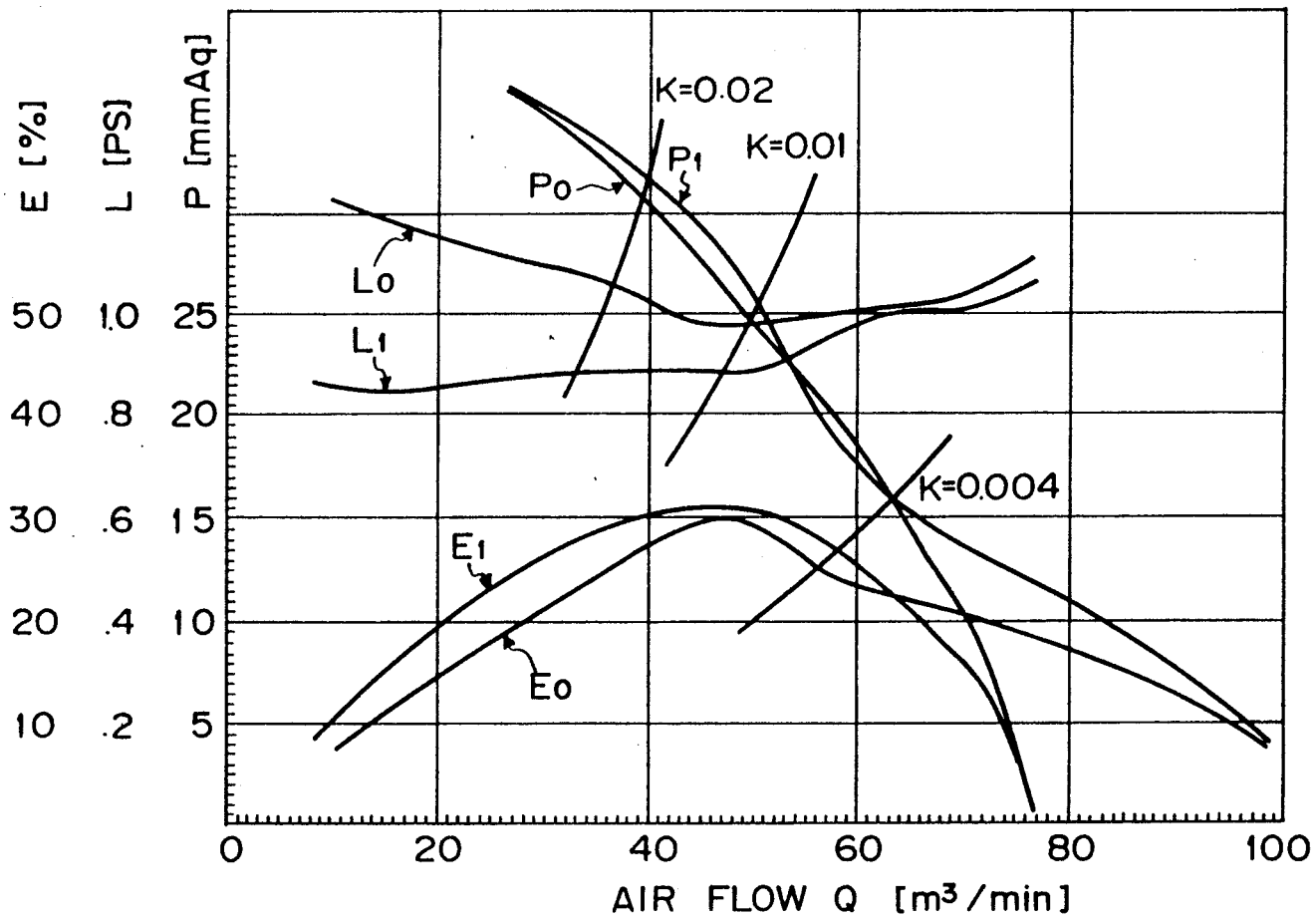
FIG. 5 is a graph showing characteristic curves of the fan.

FIG. 5 shows several characteristic curves which represent changes of three kinds of values, i.e., absorption power L, static pressure P, and fan efficiency E calculated by a change of static pressure. These experimental values are plotted in relation to the volume of air flow Q. The curves P0, L0, E0 represent a case of null resistant plate. The curves P1, L1, E1 represent a case having a most efficient resistant plate as described before. In addition, three resistance curves are shown in FIG. 5. These curves represent resistance coefficients k of 0.004, 0.01 and 0.02, respectively.

With reference to the static pressure P, there is no distinguished difference between the values P1 and P0. On the other hand, with reference to the absorption power L, a remarkable difference is recognized between the curves L1 and L0. When the resistant plate is applied to the fan, the absorption power becomes smaller. Especially in the area of high resistance, the reduction of the absorption power reaches about 40 percent. Also, with reference to the fan efficiency E, a distinguishable difference is recognized. In the maximum area, about 20 percent increase of fan efficiency is obtained.

It should be noted that many modifications can be applied to the arrangement of the present invention.

I claim:

1. In an internal combustion engine having an engine housing and an output shaft extending from said engine housing, a fan apparatus comprising:

a fan attached to said output shaft; and a circular resistance plate disposed between said engine housing and said fan extending perpendicularly relative to said output shaft and surrounding said output shaft so as to deflect an airflow flowing from said fan radially away from said output shaft;

wherein said resistance plate has an outside diameter in a range of 80 to 90 percent of the outside diameter of said fan; and wherein said fan has a central fan boss and said circular resistance plate has a small disk portion attached to said fan boss, a tubular portion extending parallel to said output shaft from said small disk portion and a large disk portion extending radially relative to said output shaft from said tubular portion.

2. In an internal combustion engine having an engine housing and an output shaft extending from said engine housing, a fan apparatus comprising:

a fan attached to said output shaft; and a circular resistance plate disposed between said engine housing and said fan extending perpendicularly relative to said output shaft and surrounding said output shaft so as to deflect an airflow flowing from said fan radially away from said output shaft;

wherein said resistance plate has an outside diameter in a range of 80 to 90 percent of the outside diameter of said fan; and wherein said fan has a central fan boss and said circular resistance plate has a small disk portion attached to said fan boss, a large disk portion extending radially relative to said output shaft from said tubular portion and a frusto-conical tubular portion interconnecting said small disk portion and said large disk portion.

* * * * *